US006406374B1

(12) United States Patent
Kanamaru et al.

(10) Patent No.: US 6,406,374 B1
(45) Date of Patent: Jun. 18, 2002

(54) OUTER RING OF A CONSTANT VELOCITY UNIVERSAL JOINT AND MANUFACTURING METHOD FOR THE SAME

(75) Inventors: Hisanobu Kanamaru; Nobuyuki Ishinaga; Kazuto Kobayashi, all of Sagamihara; Akira Matsumura, Atsugi, all of (JP)

(73) Assignee: Aida Engineering Co., Ltd. (JP)

( * ) Notice: Subject to any disclaimer, the term of this patent is extended or adjusted under 35 U.S.C. 154(b) by 0 days.

(21) Appl. No.: 09/578,754

(22) Filed: May 25, 2000

(30) Foreign Application Priority Data

May 27, 1999 (JP) ..... 11-147972
Aug. 26, 1999 (JP) ..... 11-239451

(51) Int. Cl.[7] ..... F16D 3/16

(52) U.S. Cl. ..... 464/146; 403/359.1; 72/60; 464/111; 464/905; 464/906

(58) Field of Search ..... 464/111, 145, 464/146, 905, 906; 403/359.1, 359.5; 72/57, 61, 62, 60

(56) References Cited

U.S. PATENT DOCUMENTS 3,889,506 A 6/1975 Shaffer
3,907,371 A 9/1975 Luedi et al.
4,460,630 A * 7/1984 Nishino et al. ..... 427/376.2
5,085,068 A * 2/1992 Rhoades et al. ..... 72/60
5,451,185 A * 9/1995 Krude et al. ..... 464/145
5,913,633 A * 6/1999 Shimizu et al. ..... 464/905
5,918,494 A * 7/1999 Kojima et al. ..... 72/62
6,014,879 A * 1/2000 Jaekal et al. ..... 72/61
6,105,409 A * 8/2000 Kojima et al. ..... 72/57

FOREIGN PATENT DOCUMENTS

EP 00304537 12/2001
GB 633183 12/1949

* cited by examiner

*Primary Examiner*—Lynne H. Browne
*Assistant Examiner*—Aaron M Dunwoody
(74) *Attorney, Agent, or Firm*—Morrison Law Firm

(57) ABSTRACT

A groove is cut into an end surface of a shaft component to deform the shaft component into irregularities provided on a tubular component, thereby coupling the shaft component with the tubular component to form an outer ring for a constant velocity joint. This type of joint provides an outer ring having a strong coupling force and high coupling precision. The irregularities are preferably in the form of a spline cut in a portion of an inner perimeter surface of the tubular component, at a location where coupling of the tubular component with the shaft component is desired. The spline optionally includes a notch which provided additional coupling strength, especially in the shaft direction. The tubular component is shaped by pressing the inner surface of the tubular component into a mandrel having an outer surface shape of the desired inner surface shape of the tubular component. Hydraulic pressure is used to supply the force to press the material onto the mandrel to form the tubular component. This shaping method results in a molded material with high precision without requiring bond treatment.

18 Claims, 15 Drawing Sheets

Fig. 9
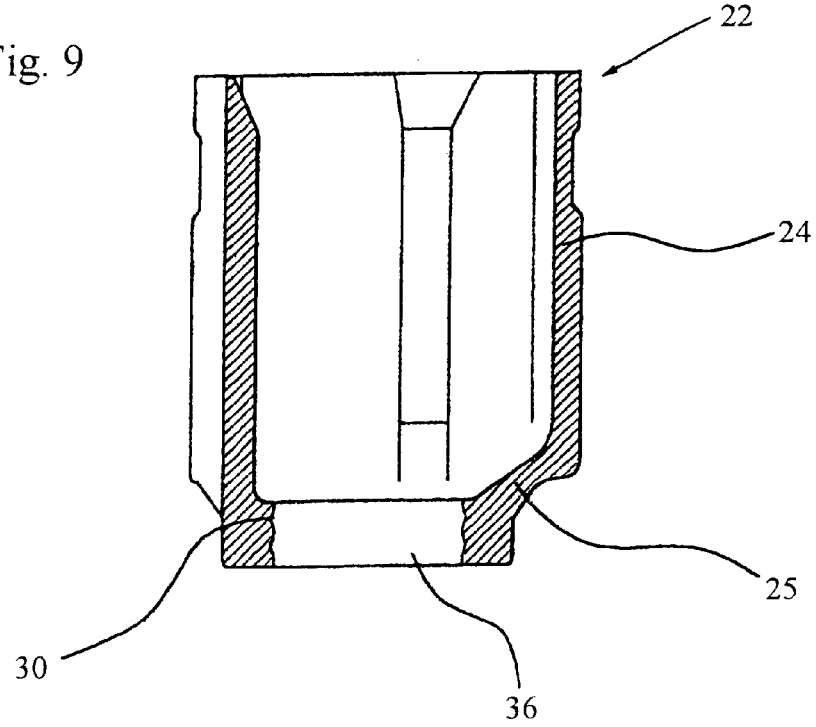
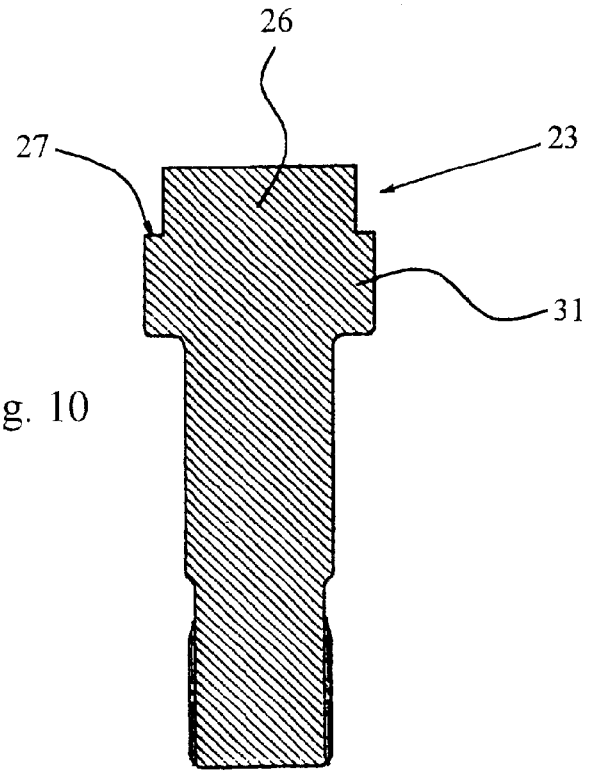
Fig. 10

OUTER RING OF A CONSTANT VELOCITY UNIVERSAL JOINT AND MANUFACTURING METHOD FOR THE SAME

BACKGROUND OF THE INVENTION

The present invention relates to a molding method for components having grooves and the like in its inner diameter and a molding device for the same. More specifically, the relevant components are preferably tubular components, such as constant velocity joint outer rings and internal gears and the like for automobiles. The grooves and the like refer to grooves which guide rolling elements and irregularities of gears. Constant velocity joints include tripod type, ball joint type, Rzeppa type, and the like. Internal gears include helicals. The present invention also relates to an outer ring for a constant velocity universal joint used in drive systems and the like of automobiles. The present invention further relates to a method of joining a tubular component and a shaft component useful in, for example, universal joints of automobile drive systems.

Conventional outer rings for constant velocity joints include a tubular component and a shaft component press molded in a unitary manner by a multi-step cold forging process. This multi-step process includes annealing and surface lubrication treatment of a cylindrical material, forward extrusion, swaging, annealing and surface lubrication treatment, rear extrusion, annealing and surface lubrication treatment, and, in the inner perimeter of the tubular component, molding of a catching part to engage with a bearing.

In recent years, in order to lighten the outer ring of the constant velocity joint, a method has been introduced wherein the outer ring of the constant velocity joint is separated into a tubular component and a shaft component. After press working to form these components, they are coupled and made unitary. The present inventors have studied methods for coupling the tubular component and shaft component of such outer rings of a constant velocity joint.

Japanese Laid-Open Publication No. 7-317792 discloses an outer ring of a constant velocity joint and its manufacturing method. A pipe is used and molded into a shell type outer ring. This conventional outer ring has a tubular component, a joint part, and a cylindrical part. A serration groove is formed on the cylindrical part, or, in the alternative, the cylindrical part is formed as a polygon. One end of the cylindrical part is coupled with the shaft. In another embodiment, a joining member is disposed between the cylindrical part and the shaft.

However, with respect to the coupling between the shell type outer ring, which is formed from pipe material, and the shaft, the coupling strength is determined by the thickness of the pipe material. Therefore, a uniform coupling force is unachievable with such a construction. Furthermore, with respect to outer rings in which a joining member is pushed into the cylindrical part, extra costs are needed to manufacture joining members having a plurality of grooves of flat surfaces in the shaft direction of the inner and outer perimeter surfaces. Extra costs and labor are also incurred from the process required for pushing the joining member into the cylindrical part. Additionally, because the constant velocity joint is constructed by the coupling of three components, specifically the outer ring, joining member, and shaft, the coupling precision of the joint part of the outer ring and shaft is a source of additional concern.

Japanese Laid Open Patent Publication No. 8-49727 discloses a constant velocity joint construction wherein a hole is provided on a shell type outer ring (tubular component). The tubular component is formed by press molding of a plate material. A plurality of grooves or flat surfaces are formed in the shaft direction of the inner perimeter surface of this hold. After a protruding part of the shaft is pushed in and engaged with the tubular component, the end surface of the protruding part is swaged. As a result, the shell type outer ring and the shaft are joined in a unitary manner.

However, with this conventional coupling method, the coupling force generated where the outer ring and the shaft are pushed in and engaged is reduced by the swaging of the end surface of the protruding part. Furthermore, because only the thickness of the outer ring is the part which engages with the shaft, a large coupling force is not anticipated. When pushing in the shaft into the outer ring, the part which engages is only the thickness of the plate of the outer ring. As a result, the engaging length is short, and there is concern that the outer ring could become deformed. The coupling precision of the tubular component and the shaft component is also a concern.

Conventional tubular components are manufactured by heat forging, cold forging, cutting, or by a method which combines two or more of these methods.

U.S. Pat. No. 2,523,372 shows an example of a technology in which a constant velocity outer ring is manufactured by heat forging and cold forging. In this patent publication, in the section entitled "Problems to be solved by the invention", it is stated that "when molding a cup-shaped component such as a constant velocity joint outer ring, so-called rear extrusion is conducted using a punch that is the same shape as the cup inner surface shape. However, stress concentrates on one part of the punch, and cracks can occur easily, and the generation of these cracks is very sensitive to the size of the molding load. The lifespan of the mold can be greatly influenced by small differences in the stress value."

According to the above conventional processing method, an excessive stress is applied on the die, and the lifespan of the die is short. In order to reduce the friction between the die and the material, bond treatment of the material is generally conducted. This bond treatment is disfavored due to environmental problems. In order to have a lighter weight, it is preferable to eliminate any excess from each part of the product. As a result, the outer shape is made to take on a modified shape to match the inner shape of the product. However, this cannot be realized due to the stress that is applied to the die. In other words, there is a large equipment cost, as well as a problem with precision.

Japanese Laid-Open Patent Publication No. 8-49727 discloses an example of a technology for manufacturing a constant velocity joint by a method of sheet metal molding of a constant velocity joint outer ring. This outer ring is then coupled with a shaft that is separately molded. When the constant velocity joint outer ring is molded from a sheet metal, stress on each part differs, and the product precision deteriorates. The molding of the desired detailed parts is difficult. There are a large number of steps, and the cost becomes high.

The above described conventional internal gear is manufactured by broaching the gear part and welding with a flange part which has been separately molded. It is not mass produced by cold forging. Broaching generates cutting shavings. As a result, such a method is unable to be deemed energy conserving.

OBJECTS AND SUMMARY OF THE INVENTION

It is an object of the present invention to provide a molding method and device for forming a tubular component which overcomes the foregoing problems.

It is another objection of the present invention to provide a molding method and device for forming a tubular component which has high precision, has a long die lifespan, does not require bond treatment, and is energy conserving.

It is a further object of the present invention to provide an outer ring for a constant velocity joint and a manufacturing method for the same which overcomes the foregoing problems.

It is still a further object of the present invention to provide an outer ring for a constant velocity joint and a manufacturing method for the same which, in order to lighten the overall weight, is composed by coupling a tubular component and a shaft component which are molded by press working.

It is another object of the present invention to provide an outer ring for a constant velocity joint and a manufacturing method for the same which has a strong coupling force and a high coupling precision.

Briefly stated, the present invention provides a groove cut into an end surface of a shaft component to deform the shaft component into irregularities provided on a tubular component, thereby coupling the shaft component with the tubular component to form an outer ring for a constant velocity joint. This type of joint provides an outer ring having a strong coupling force and high coupling precision. The irregularities are preferably in the form of a spline cut in a portion of an inner perimeter surface of the tubular component, at a location where coupling of the tubular component with the shaft component is desired. The spline optionally includes a notch which provided additional coupling strength, especially in the shaft direction. The tubular component is shaped by pressing the inner surface of the tubular component into a mandrel having an outer surface shape of the desired inner surface shape of the tubular component. Hydraulic pressure is used to supply the force to press the material onto the mandrel to form the tubular component. This shaping method results in a molded material with high precision without requiring bond treatment.

According to an embodiment of the present invention, there is provided a method for molding a material into a molded component comprising: covering a mandrel with the material; forming an enclosed fluid space on at least a portion of an exterior surface of the material; pressurizing a fluid in the enclosed fluid space.

According to a feature of the present invention, there is provided a molding device for molding a material into a molded component, comprising: means for generating a hydraulic pressure within the molding device; a mandrel having an exterior shape substantially conforming to a desired interior shape of the molded component; and the material covering the mandrel, whereby the hydraulic pressure is supplied to at least a portion of an exterior surface of the material.

According to another embodiment of the present invention, there is provided an outer ring for a constant velocity joint, comprising: a tubular component having a tube part and a bottom part; a shaft component having a small diameter part on an end portion; a step part on the shaft component having a diameter different from the small diameter part; a through hole at a substantially center region of the bottom part; the through hole having irregularities on at least a portion of an inner perimeter surface; and the tubular component and the shaft component being coupled by inserting the small diameter part of the shaft component into the through hole and press working a groove onto the an end surface of the small diameter part, thereby deforming the shaft component into the irregularities.

According to a feature of the present invention, there is provided a method for manufacturing an outer ring for a constant velocity joint, comprising: providing a tubular component having a tube part and a bottom part; providing a shaft component having a small diameter portion on an end portion; the shaft component having a step part with a diameter different from the small diameter part; the bottom part having a through hole at a substantially central region; the through hole having irregularities on at least a portion of an inner perimeter surface; inserting the small diameter part of the shaft component into the through hole of the tubular component; and press working a groove onto an end surface of the small diameter part, thereby deforming the shaft component into the irregularities.

In the method for forming a tubular component, the present invention includes a hydraulic pressure generating part that is capable of generating a high pressure. A material is placed covering a mandrel, which has an outer shape that, when the irregularities are inverted, becomes the inner surface shape of the component. The material is molded by applying high hydraulic pressure, which is generated in the hydraulic pressure generating part, to the outside of the material.

According to the present invention, in a method in which a metal material is molded by high hydraulic pressure which is generated in a place connecting to a molding die, the material is placed covering a mandrel. The high hydraulic pressure is applied to the outside of the material, resulting in the material being molded in accordance with the outer shape of the mandrel.

According to a feature of the present invention, the above described high hydraulic pressure is generated by moving a piston which is provided on the above described molding die.

According to another feature of the present invention, the above described material is pushed into the above described mandrel.

According to another feature of the present invention, the above described high hydraulic pressure is preferably at least two times greater than the deformation resistance of the above described metal material.

According to another feature of the present invention, a counter punch is provided on the outside of the above described mandrel. The end of the counter punch is tapered.

According to an embodiment of the present invention, a device, providing the molded component according to the above described method, preferably includes one or more of the above described features.

The outer ring for a constant velocity joint of the present invention includes a tubular component and a shaft component which are each preferably molded by press working. A through hole is formed at the center of a bottom part of the tubular component. Irregularities are formed on an inner perimeter surface of the through hole. A small diameter part of the shaft component is inserted into the through hole. By press working a ring-shaped groove onto an end surface of the small diameter part, there is a flow of the material of the small diameter part into the irregularities of the inner perimeter surface of the through hole. This method yields the tubular component coupled with the shaft component.

The above, and other objects, features and advantages of the present invention will become apparent from the following description read in conjunction with the accompanying drawings, in which like reference numerals designate the same elements.

BRIEF DESCRIPTION OF THE DRAWINGS

FIG. 9 is a cross-sectional drawing of the tubular component prior to coupling with the shaft component.

FIG. 10 is a cross-sectional drawing of the shaft component prior to coupling with the tubular component.

DETAILED DESCRIPTION OF THE INVENTION

Figure 1C:
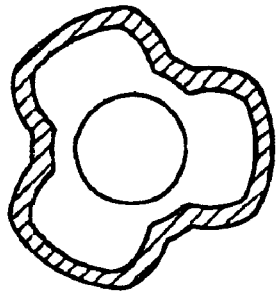
FIG. 1*c* is a cross-sectional drawing of the molded material of FIG. 1*b*, taken along line c—c.
Figure 1A:
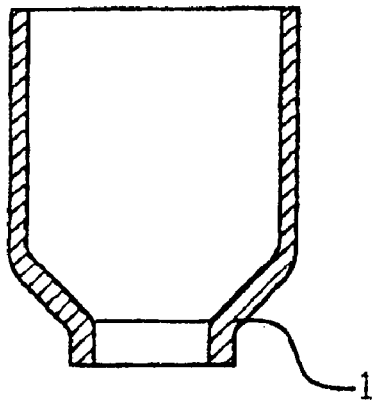
FIG. 1*a* is a cross-sectional drawing of a material prior to being molded.
Figure 1B:
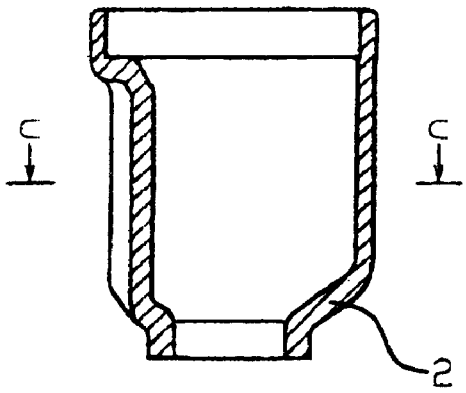
FIG. 1*b* is a cross-sectional drawing of a material molded according to the process of the present invention.

Referring to FIGS. 1*a*–1*c*, descriptive diagrams for the process of the present invention are shown. FIG. 1*a* shows a material 1 prior to being molded. FIG. 1*b* shows a molded material 2 after being subjected to the molding process. FIG. 1*c* shows a cross-section of material 1 along line c—c of FIG. 1*b*. Material 1 is molded into molded material 2 by the later described process of the present invention. Molded material 2 is preferably made from a pipe of solid material which is hollow. Molded material 2 is useful as a tripod-type constant velocity joint outer ring. Molded material 2 is anchored to a shaft member, as will be later described, to become the final product.

Figure 2:
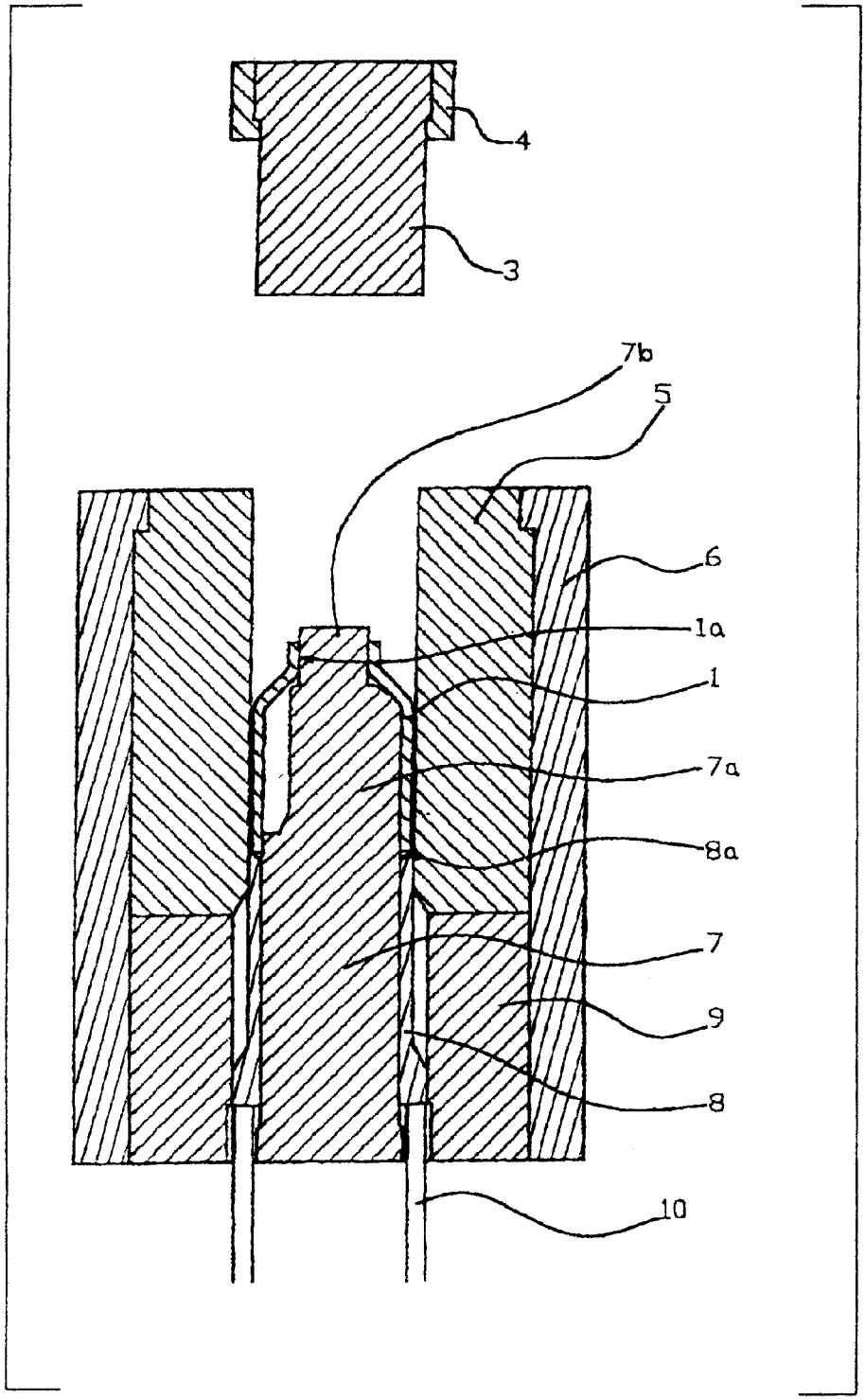
FIG. 2 is a longitudinal cross-sectional drawing of a molding device according to the present invention, prior to beginning the molding process.

Referring to FIG. 2, a device for molding material 1 into molded material 2 includes an upper mold having a piston 3 attached to a guide ring 4. A lower mold includes a guide ring 6 housing a container 5. A block 9 is positioned adjoining container 5, within guide ring 6. The upper mold is preferably anchored to a slide of a machine press. The lower mold is preferably anchored to a bolster of the machine press. The upper mold ascends and descends with the ascending and descending motion of the slide. Material 1, supplied to the lower mold, is molded by the upper mold and the lower mold.

Piston 3 is anchored to the upper mold part by guide ring 4. Container 5 and block 9 are anchored by guide ring 6 to the lower mold part. Mandrel 7 and a counter punch 8 are provided in the hollow section of container 5 and block 9. Mandrel 7 is anchored to the lower mold part. Counter punch 8 is built into the outside of mandrel 7. Counter punch 8 freely ascends and descends by motion of a knockout pin 10. Material 1 is supplied to the lower mold part to cover mandrel 7. A mandrel small diameter part 7*b* mates with a small diameter part 1*a* of material 1. Small diameter part 7*b* and small diameter part 1*a* forms a seal to seal out the liquid, preferably oil, used for the molding of material 1.

A tapered part 8*a* of counter punch 8 abuts against a large diameter opening of material 1. Tapered part 8*a* is tapered from the inner diameter part towards the outer diameter part. As with insertion part 1*a* previously described, the object of tapered part 8*a* is to seal the operation liquid, preferably oil. That is, the large diameter part of material 1 is molded into a tapered shape in accordance with tapered part 8*a* and is kept in tight contact therewith, whereby oil is prevented from entering the interior of material 1.

Figure 3:
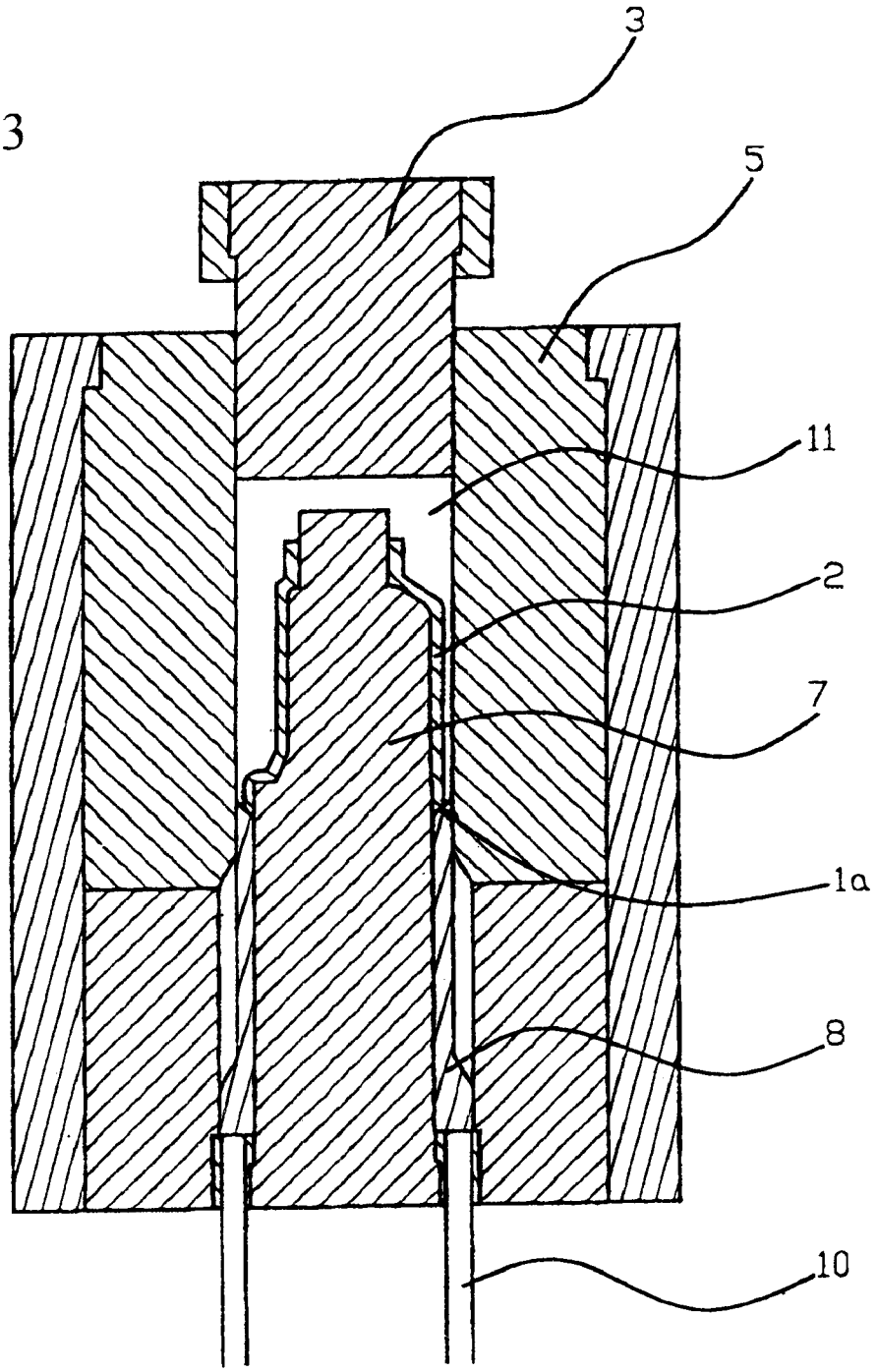
FIG. 3 is a longitudinal cross-sectional drawing of a molding device according to the present invention after completion of the molding process.

Referring to both FIGS. 2 and 3, oil 11 is supplied to the hollow part of container 5. Piston 3 descends together with the descending motion of the slide. Oil 11 is compressed by piston 3, preferably resulting in an oil pressure approximately more than two times the deformation resistance of material 1. By the action of the pressurized oil 11, material 1 is molded according to the shape of mandrel 7 to become molded material 2. When molding is completed, the slide ascends to extract piston 3 from container 5.

Together with the rising motion of knockout pin 10, molded material 2, presently on mandrel 7, is pushed up via counter punch 8. This action frees molded material 2 from mandrel 7, allowing molded material 2 to be removed from container 5, thus completing the molding process.

Figure 4C:
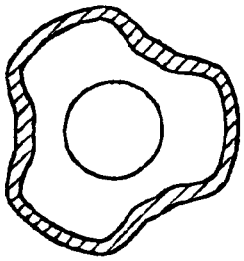
FIG. 4*c* is a plan view drawing of the molded material of FIG. 4*a*.
Figure 4D:
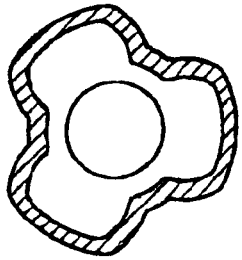
FIG. 4*d* is a plan view drawing of the molded material of FIG. 4*b*.
Figure 4A:
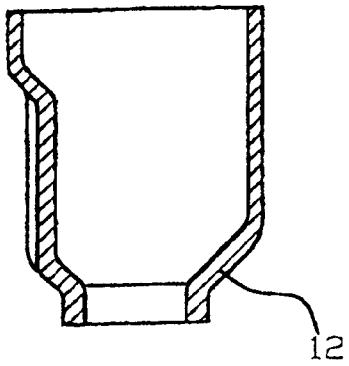
FIG. 4*a* is a cross-sectional drawing of a molded material according to an alternate embodiment of the present invention.
Figure 4B:
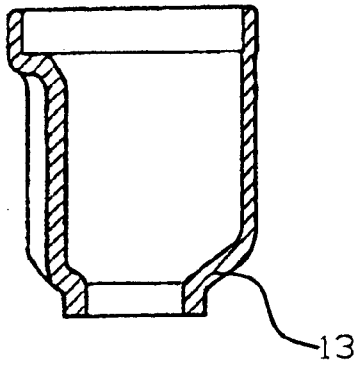
FIG. 4*b* is a cross-sectional drawing of a molded material according to an alternate embodiment of the present invention.

Referring to FIGS. 4*a*–4*d*, an alternate embodiment of the present invention is shown wherein the shape of a material 12 is closer to the shape of molded material 13 prior to molding. FIG. 4*a* shows material 12. FIG. 4*b* shows a molded material 13. FIG. 4*c* is a plan view of material 12, and FIG. 4*d* is a plan view of molded material 13. Material 12 is preferably a pipe of a solid material that has been molded. Material 12 has a modified shape part closer to the shape of molded material 13. Molded material 13 is useful in a constant velocity joint outer ring of the tripod type. Molded material 13, as will be later described, is attached to a shaft member to become the final product.

Figure 5C:
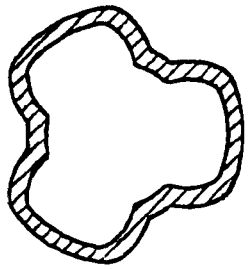
FIG. 5*c* is a plan view drawing of the molded unitary component and shaft part of FIG. 5*b*.
Figure 5A:
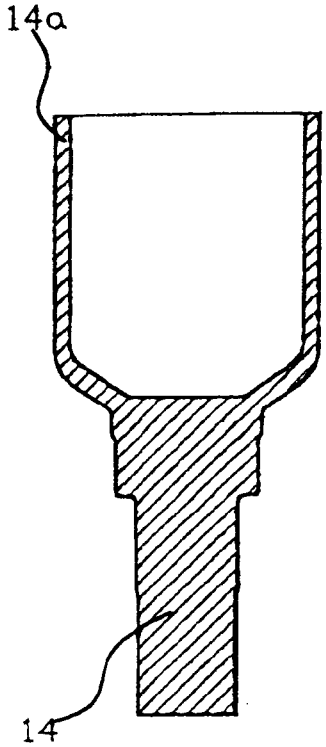
FIG. 5*a* is a cross-sectional drawing of a unitary component and shaft part prior to being molded.
Figure 5B:
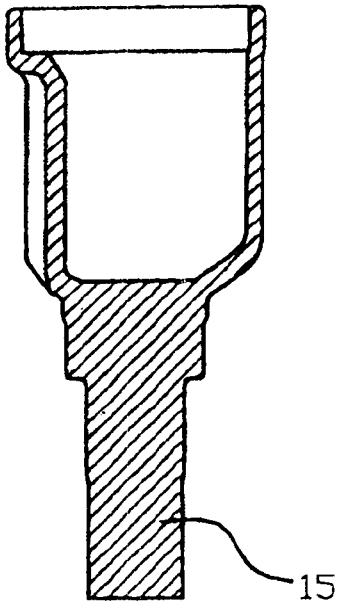
FIG. 5*b* is a cross-sectional drawing of a unitary component and shaft part after being molded according to the process of the present invention.

Referring to FIGS. 5*a*–5*c*, a material 14 is molded, by the method previously described, into molded material 15. In this alternate embodiment of the present invention, the shaft member is made unitary with material 14.

Figure 6:
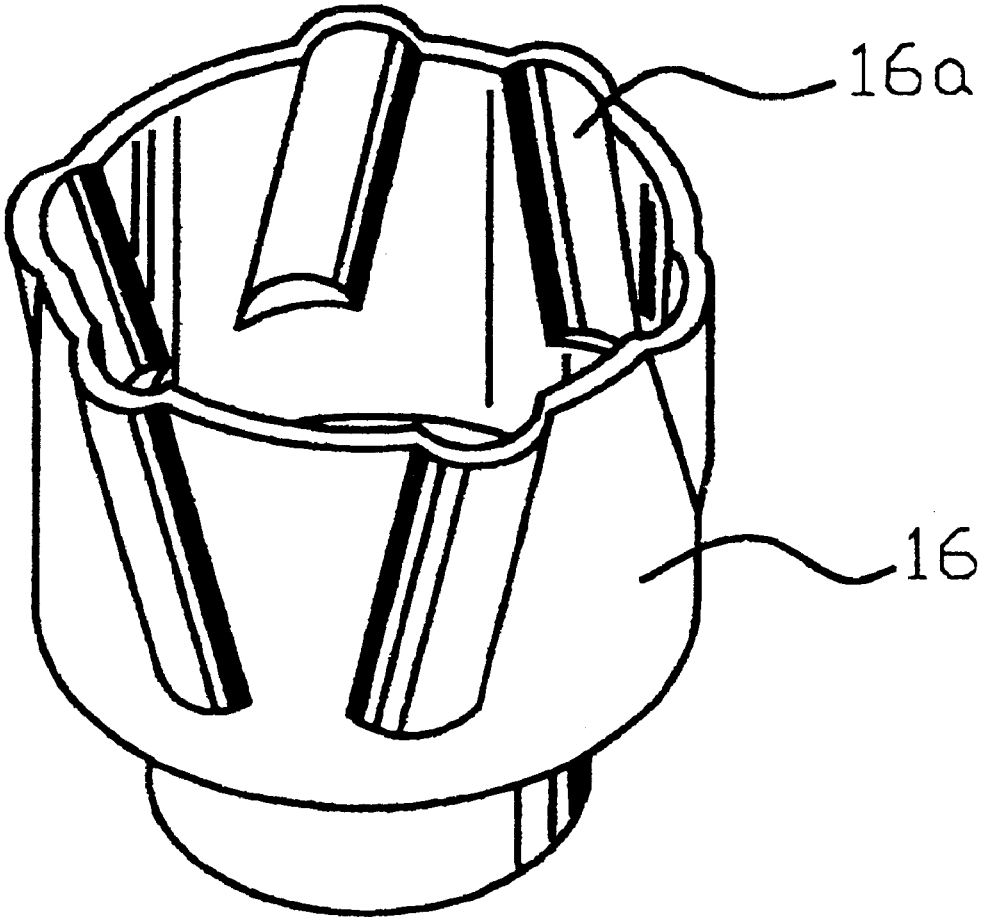
FIG. 6 is a perspective drawing of a molded product according to an alternate embodiment of the present invention.

Referring to FIG. 6, a molded material 16 is a constant velocity joint outer ring having a cross groove 16*a*.

Figure 7C:
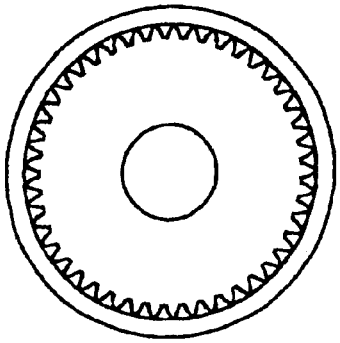
FIG. 7*c* is a plan view drawing of the molded material of FIG. 7*b*.
Figure 7A:
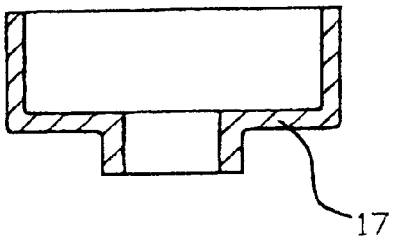
FIG. 7*a* is a cross-sectional drawing of a material according to an alternate embodiment of the present invention, prior to being molded.
Figure 7B:
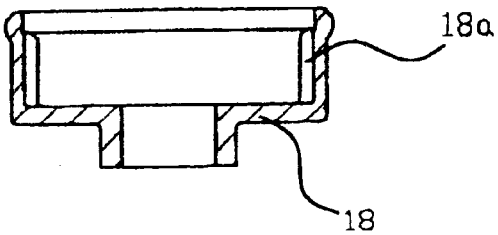
FIG. 7*b* is a cross-sectional drawing of the material of FIG. 7*a*, molded according to the process of the present invention.

Referring to FIGS. 7*a*–7*c*, a material 17 is molded into molded material 18. Molded material 18 includes an inner gear 18*a*.

Figure 8C:
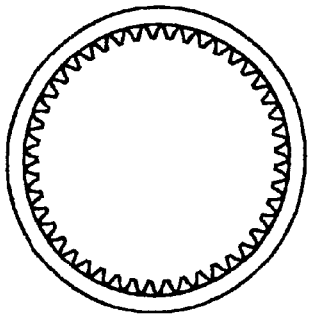
FIG. 8*c* is a plan view drawing of the molded material of FIG. 8*b*.
Figure 8A:
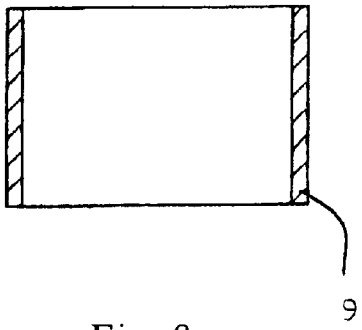
FIG. 8*a* is a cross-sectional drawing of a material according to an alternate embodiment of the present invention, prior to being molded.
Figure 8B:
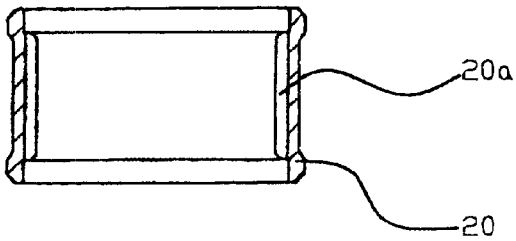
FIG. 8*b* is a cross-sectional drawing of the material of FIG. 8*a*, molded according to the process of the present invention.

Referring to FIGS. 8*a*–8*c*, a material 19 is molded into molded material 20. Molded material 20 includes an inner gear 20*a*. Molded material 20 is only the gear part of inner gear 20*a*. A flange is subsequently attached to molded product 20 to become the final product.

According to one embodiment of the present invention, hydraulic pressure in an oil causes a stress to be applied uniformly over the entire molded part. As a result, a high precision product is obtained. Furthermore, because the method the molding method of the present invention is not dependent upon relative motion of a die, there is no interference of the flow of the metal material from resistance due to friction, resulting in relatively facile formation of complex shapes. As a result, the lifespan of the device is long, and bond treatment is unnecessary. Furthermore, because a pressure of greater than two times the deformation resistance of the metal material is applied, a product with a complex shape that requires high precision is readily formed.

Referring to FIGS. 9 and 10, a tubular component 22 and a shaft component 23 are joined to form an outer ring 21 (not shown) for a constant velocity joint. Tubular component 22, having a tube part 24 and a bottom part 25, is molded by press working as previously described. A through hole 36 is at the center of bottom part 25. Irregularities 30 are provided on the inner perimeter surface of through hole 36. Furthermore, the lower end of bottom part 25 is a tubular shape having through hole 36. The upper end of bottom part 25 is connects to tube part 24.

Shaft component 23 has a small diameter part 26 and a step part 27, having a diameter different from small diameter part 26. Shaft component 23 is preferably formed from press working a cylindrical material. Small diameter part 26 is formed on the end surface of shaft component 23. Small diameter part 26 is approximately the same diameter as through hole 36 of bottom part 25 of tubular component 22. Small diameter part 26 is connected to a large diameter part 31 of step part 27, which has a different diameter. Small diameter part 26 has dimensions in which, when inserted into through hole 36, the end is prevented from protruding above through hole 36.

Figure 11A:
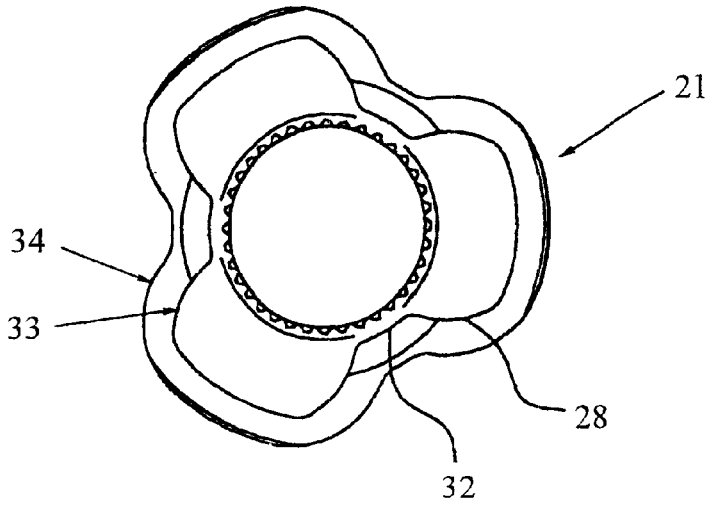
FIG. 11*a* is a plan view drawing of the tubular component prior to coupling in which the inner perimeter surface of the through hole is provided with a spline.
Figure 11B:
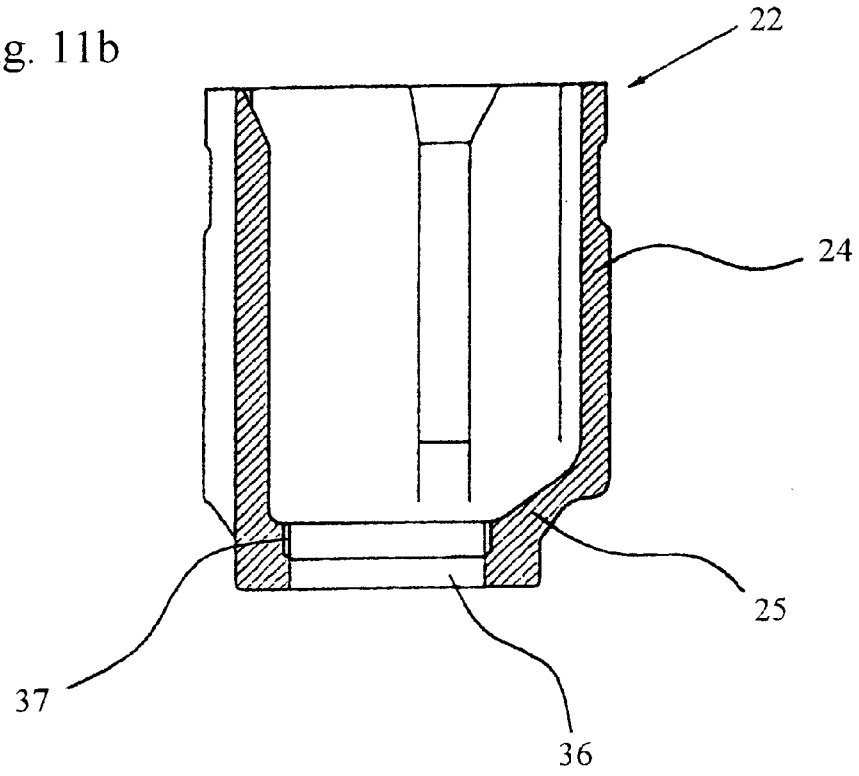
FIG. 11*b* is a cross-section drawing of the tubular component, having a spline, according to an alternate embodiment of the present invention.

Referring to FIGS. 11*a* and 11*b*, an inner perimeter shape 33 of tube part 24 has catching parts 28, which is for three bearings, and an arc 32, which joins catching parts 28. Catching parts 28 are evenly spaced in the circumferential direction.

Figure 12A:
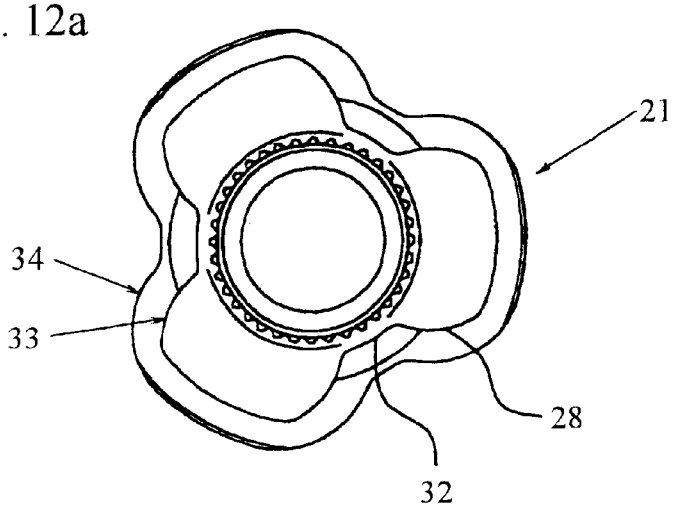
FIG. 12*a* is a plan view drawing of the tubular component of FIG. 11*a* coupled with the shaft component by the process of the present invention.
Figure 12B:
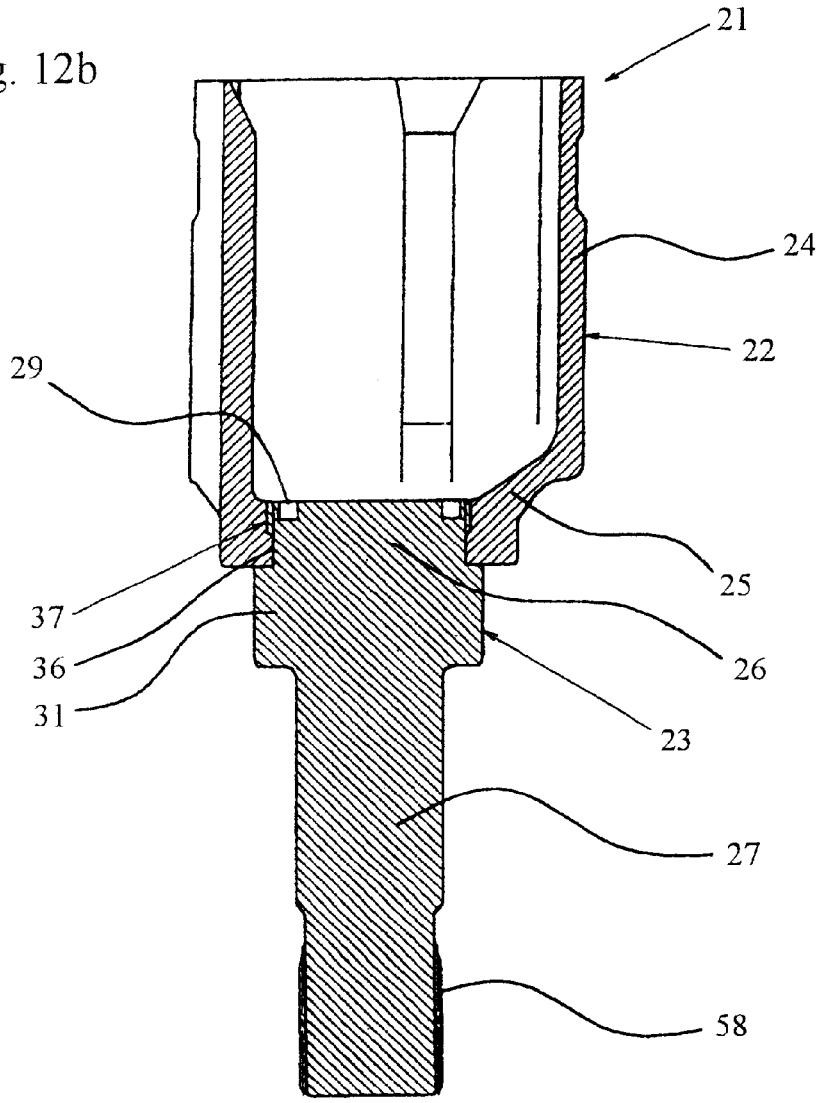
FIG. 12*b* is a cross-section drawing of the tubular component of FIG. 11*b* coupled with the shaft component by the process of the present invention.

Referring to FIGS. 12*a* and 12*b*, outer perimeter shape 34 is a shape similar to inner perimeter shape 33.

Figure 13A:
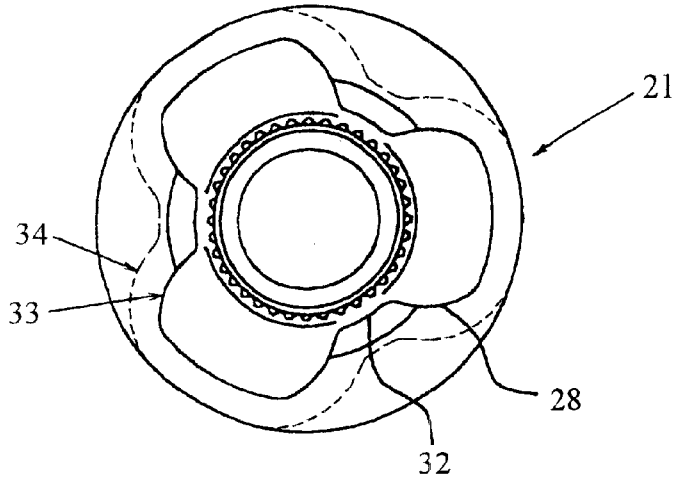
FIG. 13*a* is a plan view drawing of a tubular component, having a circular-shaped section, coupled with the shaft component by the process of the present invention.
Figure 13B:
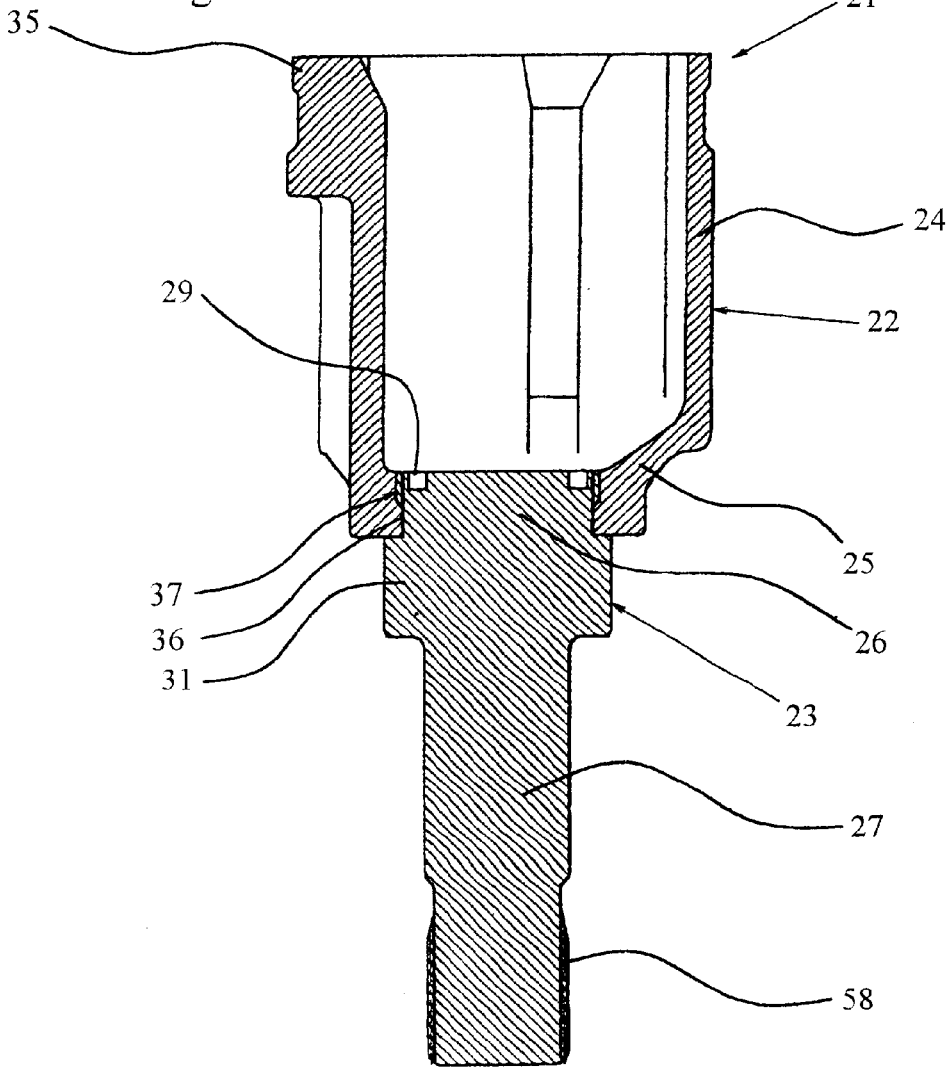
FIG. 13*b* is a cross-sectional drawing of the coupled outer ring for a constant velocity joint of FIG. 13*a*.

Referring to FIGS. 13*a* and 13*b*, a section starting from the end surface of tube part 24, in the shaft direction, is a circular shape 35. Therefore, compared to the outer ring for the constant velocity joint of the prior art in which the entire outer diameter of tube part 24 is circular shape, the outer ring 21 for the constant velocity joint of the present invention is lightweight.

Referring to FIGS. 12*b* and 13*b*, the coupling method for tubular component 22 and shaft component 23 will be described. First, small diameter part 26 is inserted into through hole 36 until the bottom end surface of tubular component 22 contacts step part 27. A ring shaped groove 29 is formed on the top end surface of small diameter part 26.

In the process of molding groove 29, the outer diameter of small diameter part 26 tries to increase due to deformation. As a result, the material of small diameter part 26 flows into the space between the outer diameter of small diameter part 26 and irregularities 30 of the inner perimeter surface of through hole 36. Coupling between tubular component 22 and shaft component 23 occurs. This coupling of tubular component 22 and shaft component 23 is formed without any play therebetween with respect to torque in the circumferential direction and the pullout force in the shaft direction is achieved.

Figure 14:
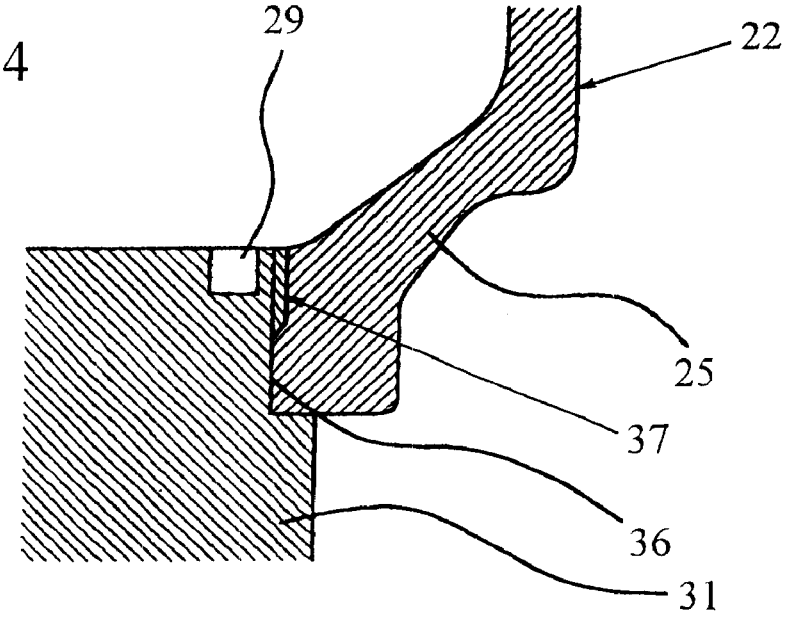
FIG. 14 is a close-up cross-sectional drawing showing the coupling portion of the tubular component and the shaft component.

Referring FIGS. 11*a*, 11*b* and 14, instead of irregularities 30 on the inner perimeter surface of through hole 36, a spline 37 can be provided. From the tube part 24 side, spline 37 is formed partway into the thickness of bottom part 25. Furthermore, in order for the material of small diameter part 26 to flow to the end of spline 37 in the shaft direction without allowing any space, it is necessary to have adequate width and depth for groove 29. This results in a more stable torque resisting force in the coupling of tubular component 22 and shaft component 23.

Figure 15:
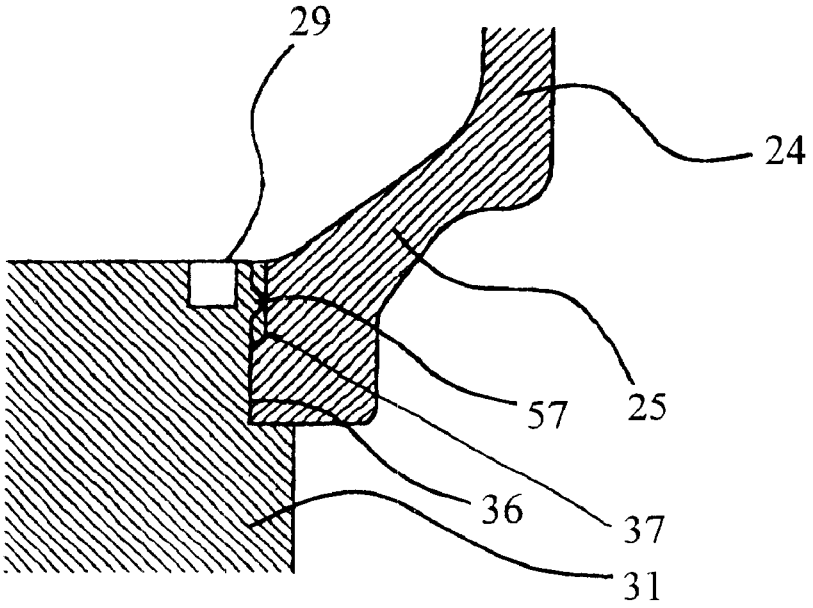
FIG. 15 is a close-up cross-sectional drawing showing an alternate embodiment of the coupling portion of the tubular component and the shaft component.

Referring now to FIG. 15, partway along spline 37 in the shaft direction, spline 37 is provided in advance with a triangular notch 57, in which the small diameter of spline 37 is the base, and a distance less than the large diameter is the apex. This results in a more stable couple force of tubular component 22 and shaft component 23 in the shaft direction. The shape of notch 57 is not limited to a triangle, and can be chosen from, for example, an arc or a square shape.

Next, the press working method of spline 37 of bottom part 25 of tubular component 22 will be described.

Figure 16:
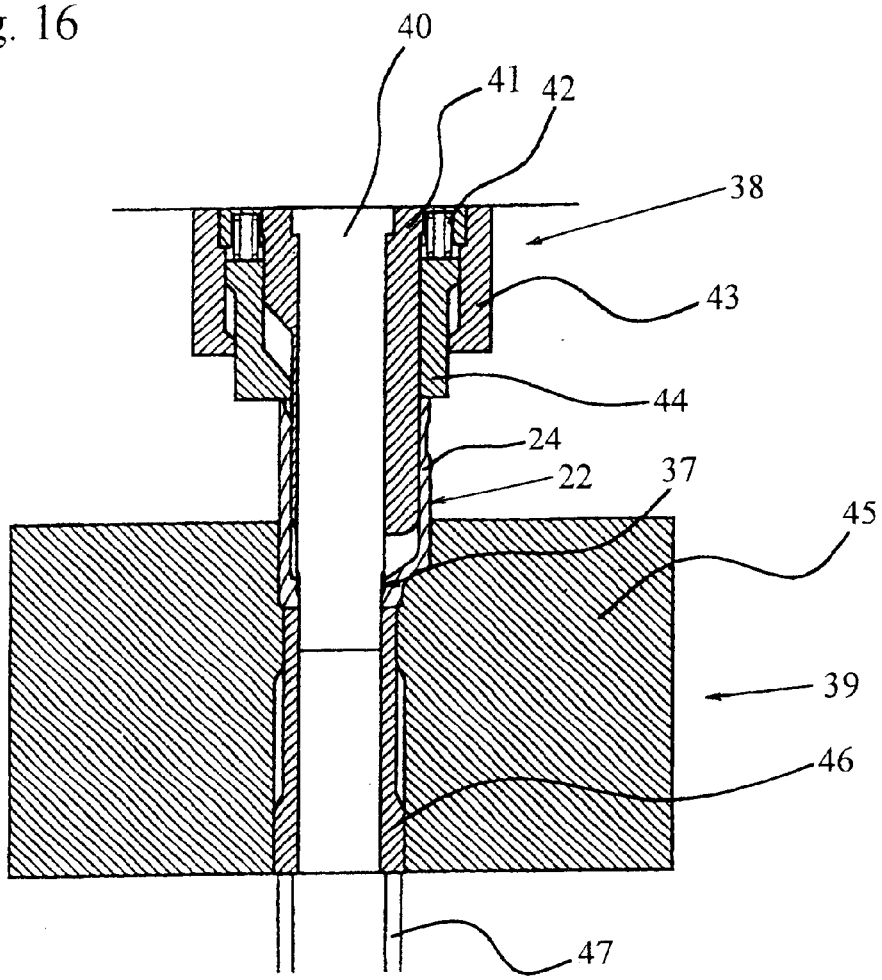
FIG. 16 is a cross-sectional drawing, showing the die construction for molding a spline into the tubular component, according to the method of the present invention.

Referring to FIG. 16, a die construction is presented for molding spline 37. An upper mold 38 is attached to a slide of a press. A lower mold 39 is attached to a bolster. A punch 40, anchored to upper mold 38, has a part in the shape of spline 37.

A holder 41 is also anchored to upper mold 38 to guide punch 40 by its inner diameter portion. The shape of the end of the outer perimeter part of holder 41 is a similar shape and slight smaller than inner perimeter shape 33 of tubular component 22. A stripper 44 on the outer side of holder 41 is impelled downwards by a spring 42. A guide 43 is anchored to upper mold 38 and guides stripper 44 in a freely ascending and descending manner.

A block 45 is anchored to lower mold 39. The cavity part is approximately the same shape as the outer perimeter shape of tube part 24 and bottom part 25. Inside block 45, there is a tube-shaped counter punch 46, which freely ascends and descends. First, tubular component 22 is placed inside block 45. At this time, the outer perimeters of tube part 24 and bottom part 25 are restricted by block 45. The lower end of bottom part 25 is held by counter punch 46.

After positioning tubular component 22 in this way, while stripper 44 impels the end surface of tube part 24 downward, holder 41 descends while catching on inner perimeter shape 33 of tubular component 22. While maintaining this state, punch 40 descends to form spline 37. Because punch 40 is guided by through hole 36 of tubular component 22 and the inner diameter of counter punch 46, spline 37 is molded with good precision at the center of tubular component 22. After completing the molding, tubular component 22 is ejected from block 45 by a knockout pin 47 via counter punch 46.

Next, the method for molding groove 29 by press working will be described.

Figure 17:
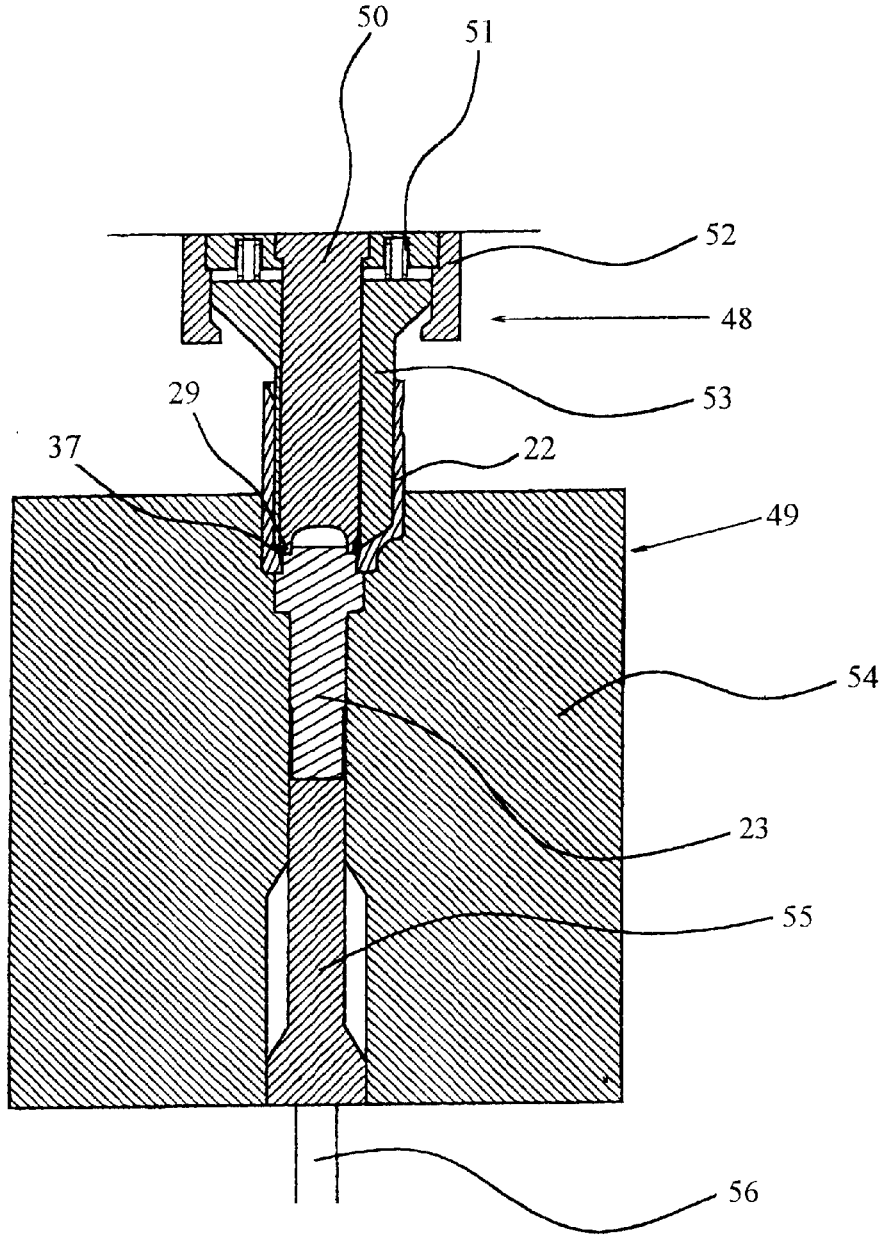
FIG. 17 is a cross-sectional drawing, showing the die construction for molding a groove into the shaft component, according the method of the present invention.

Referring to FIG. 17, spline 37 is provided on the inner diameter of through hole 36. A die construction for molding groove 29 by press working has an upper mold 48 attached to a slide of a press. A lower mold 49 is attached to a bolster. Punch 50 is anchored to upper mold 48. An end portion of punch 50 has a part shaped to form groove 29.

On the outer side of punch 50 is a stripper 53 which is impelled downward by a spring 51. A guide 52 is fastened to upper mold 48 and guides stripper 53 in a freely ascending and descending manner. The inner diameter part of stripper 53 guides punch 50. The end shape of the outer perimeter portion of stripper 53 is a similar shape and slightly smaller than inner perimeter shape 33 of tubular component 22.

A block 54 is fastened to lower mold 49. The cavity part is approximately the same shape as the outer perimeter shape of tubular component 22 and shaft component 23. A counter punch 55, inside block 54, freely ascends and descends. First, shaft component 23 is placed inside block 54. The outer perimeter of large diameter part 11 and its lower end is restrained and held by block 54. At the same time, the lower end of shaft component 23 is held by counter punch 55.

Next, tubular component 22 is placed inside block 54. At this time, tubular component 22 is placed to that through hole 36 and small diameter part 26 catch, and the lower end surface of tubular component 22 is in contact with step part 27. At the same time, the outer perimeters of tube part 24 and bottom part 25 of tubular component 22 are restricted and held by block 54.

After positioning tubular component 22 and shaft 23 in the above described manner, stripper 53 descends while catching onto inner perimeter shape 53 of tubular component 22. Stripper 53 abuts against the upper surface of bottom part 25 and impels it downward. While maintaining this condition, punch 50 descends. As a result, a ring-shaped groove 29 is molded onto the end surface of small diameter part 26. After completing the molding, the coupled tubular component 22 and shaft component 23 are ejected from block 54 by a knockout pin 56 via counter punch 55.

By coupling with this method, the outer perimeter portion of bottom part 25 and the outer perimeter of large diameter part 11 and its lower end is restricted or held by block 54. As a result, after molding groove 29, a strong tension force is generated between the material of through hold 36 and the material of small diameter part 26. A high torque force resistance is achieved, which is especially required for outer ring 21 of constant velocity joint. The coupling precision between tubular component 22 and shaft component 23 is also good.

Furthermore, the deformation from the molding of groove 29 occurs only near spline 37 and small diameter part 26. As a result, the portions which have been press worked or finished by a machine prior to coupling, for example, a catching part 28 for catching with bearings on inner perimeter shape 33 of tube part 24 of tubular component 22, or serration 58 on the end of shaft component 23, have very little deterioration in precision.

By the above action, with respect to outer ring 21 for a constant velocity joint in which tubular component 22 and shaft component 23 are constructed and coupled, an outer ring which is light and has both a strong coupling force and a high coupling precision is manufactured. In particular, with respect to what has been a problem up until now in the torque strength of the coupled portion of tubular component 22 and shaft component 23, an adequate torque strength is now satisfied.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A method for molding a material into a molded component, comprising:

covering at least a portion of a mandrel with said material;

said material including at least one free end;

forming an enclosed fluid space on at least a portion of a first exterior surface of said material by at least contacting said at least one free end of said material to said mandrel; and pressurizing a fluid in said enclosed fluid space, whereby said at least one free end of said material is held against said mandrel during molding by a hydraulic pressure of said fluid, thereby sealing said at least one free end to said mandrel and preventing passage of said fluid from said enclosed fluid space to a second interior surface of said material and allowing molding of said material into said molded component.

2. The method for molding a material into a molded component according to claim 1, wherein:

said pressurizing step being performed by hydraulic pressure;

said hydraulic pressure being generated by moving a piston into said enclosed fluid space.

3. The method for molding a material into a molded component according to claim 2, wherein:

said material is pushed into said mandrel, thereby shaping an interior portion of said material to the exterior shape of said mandrel.

4. The method for molding a material into a molded component according to claim 2, wherein:

said hydraulic pressure is at least two times greater than the deformation resistance of said material.

5. A method for molding a material into a molded component comprising:

covering a mandrel with said material;

forming an enclosed fluid space on at least a portion of an exterior surface of said material;

pressurizing a fluid in said enclosed fluid space;

said pressurizing step being performed by hydraulic pressure;

said hydraulic pressure being generated by moving a piston into said enclosed fluid space;

a die on an exterior portion of said mandrel;

an end part of said die having a taper; and said taper providing a sealing means for sealing said enclosed fluid space.

6. A molding device for molding a material into a molded component, comprising:

means for generating a hydraulic pressure within said molding device;

a mandrel having an exterior shape substantially conforming to a desired interior shape of said molded component;

said material covering at least a portion of said mandrel; and at least a free end of said material contacting a surface said mandrel, whereby said hydraulic pressure is supplied to at least a portion of a first exterior surface of said material, thereby holding said at least one free end of said material against said mandrel during a molding with said hydraulic pressure, and preventing passage of said hydraulic pressure from said first exterior to a second interior surface of said material.

7. The molding device for molding a material into a molded component according to claim 6, further comprising:

a container housing said mandrel said means includes a piston provided on a molding die; and said piston fitting into said container, thereby providing said hydraulic pressure within said container.

8. The molding device for molding a material into a molded component according to claim 7, wherein:

said material is pushed into said mandrel, thereby shaping an interior portion of said material to the exterior shape of said mandrel.

9. The molding device for molding a material into a molded component according to claim 7, wherein:

said hydraulic pressure is at least two times greater than a deformation resistance of said material.

10. A molding device for molding a material into a molded component, comprising:

means for generating a hydraulic pressure within said molding device;

a mandrel having an exterior shape substantially conforming to a desired interior shape of said molded component;

said material covering said mandrel, whereby said hydraulic pressure is supplied to at least a portion of an exterior surface of said material;

a container housing said mandrel;

said means includes a piston provided on a molding die;

said piston fitting into said container, thereby providing said hydraulic pressure within said container;

a die on an exterior portion of said mandrel;

an end part of said die having a taper; and said taper providing a sealing means for sealing said enclosed fluid space.

11. An outer ring for a constant velocity joint, comprising:

a tubular component having a tube part and a bottom part;

a shaft component having a small diameter part on an end portion;

an upper end surface on said end portion opposite a lower end surface of said shaft component;

a larger diameter part on said shaft component having an first outer diameter;

a step part on said shaft component proximate said large diameter part having a second outer diameter different from said small diameter part;

said upper end surface parallel to a step surface of said step part a through hole at a substantially center region of said bottom part;

said through hole having an internal diameter;

said second outer diameter being the same as or less than said internal diameter of said through hole;

said through hole having irregularities on at least a portion of an inner perimeter surface; and said tubular component and said shaft component being effectively coupled by inserting said small diameter part of said shaft component into said through hole and press working a groove onto said upper end surface of said small diameter part, thereby deforming at least an outer wall of at least said groove and said shaft component toward said through hole and into said irregularities.

12. The outer ring for a constant velocity joint according to claim 11, wherein said groove is a ring shaped groove.

13. The outer ring for a constant velocity joint according to claim 11, wherein:

said irregularities are a spline formed partway from said tube part side on said inner perimeter surface of said through hole.

14. The outer ring for a constant velocity joint according to claim 13, wherein said spline is molded by a press.

15. A method for manufacturing an outer ring for a constant velocity joint, comprising:

providing a tubular component having a tube part and a bottom part;

providing a shaft component having a small diameter portion on an end portion, and an upper end surface opposite a lower end surface;

said shaft component having a step part with a first diameter different from said small diameter part;

said bottom part having a through hole at a substantially central region;

said through hole having irregularities on at least a portion of an inner perimeter surface;

said first diameter of said step part being the same as or less than an internal diameter of said through hole;

inserting said small diameter part of said shaft component into said through hole of said tubular component; and press working a groove onto said upper end surface of said small diameter part, thereby deforming at least an outer wall of at least said groove and said shaft component into said irregularities and securing said tubular component to said shaft component.

16. The method of manufacturing an outer ring for a constant velocity joint according to claim 14, wherein said groove is a ring shaped groove.

17. The method of manufacturing an outer ring for a constant velocity joint according to claim 14, wherein:

said irregularities are a spline formed partway from said tube part side on said inner perimeter surface of said through hole.

18. The method of manufacturing an outer ring for a constant velocity joint according to claim 17, wherein said spline is molded by a machine press.

* * * * *